US005970389A

United States Patent [19]

Lewiner et al.

[11] Patent Number: 5,970,389

[45] Date of Patent: Oct. 19, 1999

[54] PORTABLE ONE-WAY RADIO PAGER WITH AN ENCODED SOUND SIGNAL TRANSMITTER AND IDENTIFICATION METHOD USING SAME

[76] Inventors: Jacques Lewiner, 7 Avenue de Suresnes 92210, Saint Cloud, France; Eric Carreel, 9 Rue du Général Gouraud 92190, Meudon, France

[21] Appl. No.: 08/930,905

[22] PCT Filed: Apr. 4, 1996

[86] PCT No.: PCT/FR96/00513

§ 371 Date: Feb. 19, 1998

§ 102(e) Date: Feb. 19, 1998

[87] PCT Pub. No.: WO96/31851

PCT Pub. Date: Oct. 10, 1996

[30] Foreign Application Priority Data

Apr. 7, 1995 [FR] France ..... 95 04181

[51] Int. Cl.[6] ..... H04Q 7/00

[52] U.S. Cl. ..... 455/31.2; 455/406; 455/38.1; 340/825.35

[58] Field of Search ..... 455/405, 406, 455/408, 410, 31.1, 31.2, 31.3, 38.2, 38.1, 38.4; 340/825.31, 825.35, 825.33, 82.44

[56] References Cited

U.S. PATENT DOCUMENTS

| | | | |
|---|---|---|---|
| 4,490,579 | 12/1984 | Godoshian | 179/2 |
| 5,192,947 | 3/1993 | Neustein | 340/825.44 |
| 5,615,110 | 3/1997 | Wong | 395/28 |
| 5,708,422 | 1/1998 | Blonder et al. | 340/825.34 |
| 5,878,337 | 3/1999 | Joao et al. | 455/406 |

FOREIGN PATENT DOCUMENTS

| | | |
|---|---|---|
| 0086255 | 8/1983 | European Pat. Off. . |
| 0239810 | 10/1987 | European Pat. Off. . |
| 8903233 U | 7/1989 | Germany . |

OTHER PUBLICATIONS

International Search Report dated Jun. 10, 1996.

French Search Report dated Sep. 1, 1995.

*Primary Examiner*—Reinhard J. Eisenzopf
*Assistant Examiner*—Darnell R. Armstrong
*Attorney, Agent, or Firm*—Marshall, O'Toole, Gerstein, Murray & Borun

[57] ABSTRACT

The invention relates to a portable one-way radio pager comprising pager means (4, 5, 6) for receiving radio messages, a memory (8) for storing messages, a screen (2), a keypad (3), a CPU (7), and a loudspeaker (9). The CPU is designed to recognize specific "certification primary code" messages and to cause an encoded sound signal to be emitted by the loudspeaker as a function of a secondary code keyed in by a user via the keypad, and of an additional code accessible to the CPU. The encoded sound signal enables the user to be identified.

8 Claims, 1 Drawing Sheet

PORTABLE ONE-WAY RADIO PAGER WITH AN ENCODED SOUND SIGNAL TRANSMITTER AND IDENTIFICATION METHOD USING SAME

The invention relates to portable one-way radio pagers of the kind comprising pager means for receiving radio messages, a memory for storing the messages, a screen, a keypad, a sound signal emitter, and an electronic CPU, the pager being designed to display on its screen at least some of the messages it receives, the sound signal emitter being designed to emit sound signals in a plurality of frequencies, and the CPU being designed:

to recognize, in received messages, at least a specific message fraction referred to as a "primary code" for causing an encoded sound signal to be emitted by the sound signal emitter;

to store in the memory data representative of the received primary code; and as a function of commands received from a user by means of the keypad, to cause the sound signal emitter to emit an encoded sound signal comprising a run of individual sound signals defined by the CPU as a function at least of the primary code, said encoded sound signal varying as a function of the primary code.

Document U.S. Pat. No. 4,490,579 describes an example of such a radio pager, in which the encoded sound signal corresponds to a telephone number to be called back, and encoded using a voice frequency dialing system.

The present inventors have had the idea of improving such prior art radio pagers to enable them to be used to identify people remotely, in particular to make an operation "secure", e.g. a remote payment operation, or the like.

To this end, according to the invention, a portable radio pager of the kind in question is essentially characterized in that the CPU is also designed:

to recognize at least one "certification" primary code and to display on the screen a message requesting the user of said pager to enter a secondary code by means of the keypad;

then to define the encoded sound signal as a function of the primary code, of an additional code accessible to the CPU, and of the secondary code entered with the keypad; and finally, as a function of commands received from the user by means of the keypad, to cause the encoded sound signal to be emitted by the sound signal emitter.

In preferred embodiments of the pager of the invention, use may also be made of one or more of the following dispositions:

the additional code is an internal code contained in the memory; and the pager further includes an interface enabling it to dialog with an external smart card, and in which the CPU is further designed to send an initial code that is a function of the primary code to the smart card via the interface;

after the secondary code has been input with the keypad, to send the secondary code to the smart card by means of the interface;

to receive the above-mentioned additional code, referred to as a "resultant" code, from the smart card as defined by the smart card as a function of the initial code sent thereto, of an internal code that it contains, and of the secondary code; and to define the encoded sound signal as a function of the resultant code received from the smart card.

The invention also provides a method of remotely identifying a person using a portable radio pager as defined above which receives radio messages from at least one transmitter station, the method comprising the following steps:

a) making telephone contact with the user of the pager by means of a telephone set;

b) causing the user of the pager to communicate an identification code specific to the user;

c) causing the transmitter station to transmit at least one certification primary code addressed to the pager;

d) causing the user of said pager to enter a secondary code by means of the keypad of the pager;

e) causing the sound signal emitter of the pager to emit the encoded sound signal which is defined by the CPU of the pager as a function of the primary code, of the internal code, and of the secondary code, the sound signal emitter being located at that time in the vicinity of a microphone belonging to the telephone set;

f) determining the encoded sound signal which ought to have been emitted as a function of the primary code and of the secondary code;

g) verifying whether a predetermined relationship exists between the identification code, the certification primary code, and the encoded sound signal.

Advantageously, the identification code specific to the user of the pager is included in the memory of the pager, and step b) consists in causing the sound signal emitter of the pager to emit a run of individual sound signals representative of the identification code, the signal emitter being located at that time in the vicinity of a microphone belonging to the telephone set.

The invention also provides a second method of remotely identifying a person by using a portable radio pager which receives radio messages from at least one transmitter station, the method comprising the following steps:

a') making telephone contact with the user of the pager by means of a telephone set;

b') causing the user of the pager to communicate at least one identification code specific to the smart card of the user;

c') causing the transmitter station to transmit at least one certification primary code addressed to the pager;

d') causing the initial code which is a function of the certification primary code to be sent to the smart card via the interface;

e') causing the user of said pager to enter a secondary code by means of the keypad of the pager, and causing said secondary code to be sent to the smart card via the interface;

f') causing the smart card to communicate a resultant code to the CPU, which resultant code is a function of the initial code, of the secondary code, and of the internal code contained in said smart card;

g') causing the CPU to define the encoded sound signal corresponding to the resultant code;

h') causing said encoded sound signal to be emitted by the sound signal emitter of the pager, the sound signal emitter being located at that time in the vicinity of a microphone belonging to the telephone set; and i') verifying whether a predetermined relationship exists between the identification code, the primary code, and the encoded sound signal.

Advantageously, the identification code is stored in the smart card, and step b') consists in causing the CPU to read the identification code of the smart card via the interface, and in causing the sound signal emitter to emit a run of individual sound signals representative of the identification code, the sound signal emitter being located at that time in the vicinity of a microphone belonging to the telephone set.

The above remote identification methods may advantageously include a subsequent step which consists in authorizing a remote payment operation only if it is verified that the predetermined relationship exists between the identification code, the certification primary code, and the encoded sound signal.

Other characteristics and advantages of the invention appear from the following detailed description of an embodiment thereof, given by way of non-limiting example and with reference to the accompanying drawing.

In the various figures, the same references are used to designate elements that are identical or similar.

Figure 1:
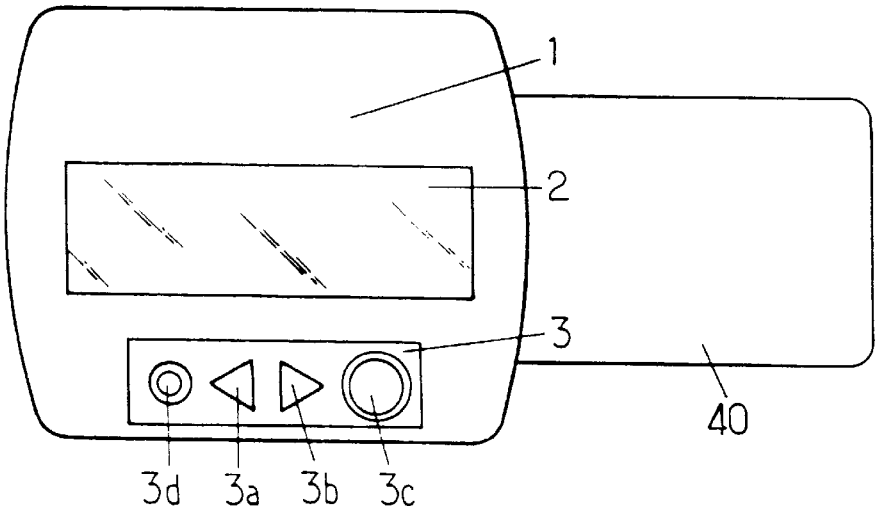
FIG. 1 shows an example of a portable radio pager of the invention.

The one-way radio pager of the invention consists in a portable unit 1 such as that shown in FIG. 1, which is designed to receive encoded radio messages transmitted by a distant transmitter station 20 (FIG. 2), the radio messages being encoded, for example, in compliance with the ERMES standard (EEC Directives 85/374 and 92/59, ETS standard 300.133-1 to -7 published by the European Telecommunications Standards Institute).

The unit is small in size, e.g. being a few centimeters in its greatest dimension, so as to make it suitable for holding in one hand.

On the outside, the unit 1 has a screen 2 for displaying all or a part of messages received by radio and addressed to said unit, and a keypad 3 having a few keys serving, in particular, to control the display of such messages, to erase them, etc.

By way of example, the keypad 3 may have four keys, namely:

- two scroll keys 3*a* and 3*b* serving in particular to move a cursor through menus displayed on the screen 2;
- a select key 3*c*, in particular for selecting an option in a menu displayed on the screen 2; and
- a key 3*d* serving in particular to make visible or to modify the menu displayed on the screen 2.

Figure 2:
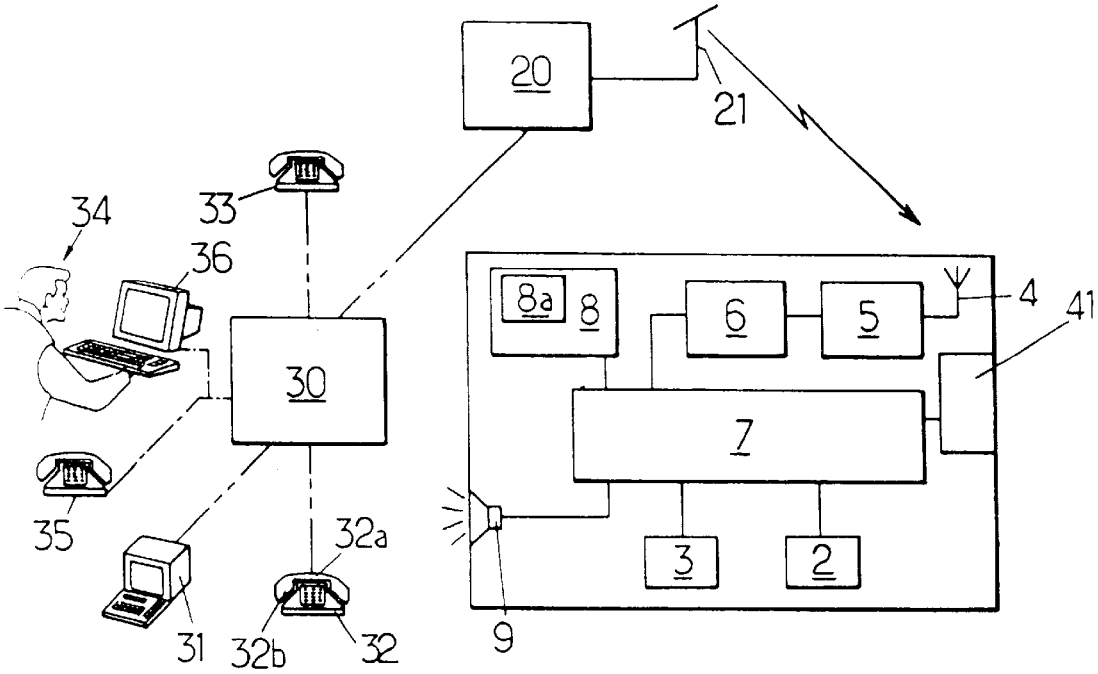
FIG. 2 is a block diagram of the FIG. 1 pager operating in its environment.

FIG. 2 shows in particular a block diagram of the pager unit 1 which comprises, in conventional manner:

- an antenna 4 for receiving radio messages transmitted by an antenna 21 of the transmitter station 20;
- an amplifier 5 connected to the antenna 4 to amplify the signals received by the antenna 4;
- a demodulator 6 connected to the output of the amplifier 5 to demodulate the amplified signals coming from the amplifier;
- an electronic CPU 7 generally constituted by a microprocessor, connected to the output of the demodulator 6 to receive, decode, and process the demodulated signals coming from the demodulator 6, the CPU 7 being connected to the screen 2 and to the keypad 3;
- a memory 8 either connected to the CPU 7 or integrated therein in part or in full; and
- a miniature loudspeaker 9 connected to the CPU 7 and designed at least to emit a warning sound signal or "beep" each time the CPU receives a radio message addressed to the pager unit 1 under consideration.

The pager unit 1 may also include a smart card reader 41 which opens to the outside of the pager unit through a slot (not shown) into which a smart card 40 (see FIG. 1) can be inserted.

The reader 41 is then connected to the CPU 7, and the CPU is programmed to dialog with the microprocessor of the smart card 40, as explained in greater detail below.

The pager unit 1 can be used to identify a person remotely, thereby making it possible specifically, but not exclusively, to make remote payment operations secure, in particular when performed by means of a bank card.

Firstly, this method of identifying a person remotely can be implemented in a pager unit 1 that does not include a smart card reader 41, or to make a remote payment operation secure by means other than a bank card, or indeed to make a remote payment operation by means of a bank card secure when the bank card does not include a microprocessor or is not compatible with the reader 41.

Under such circumstances, when the user of the pager unit 1 is in telephone communication by means of two telephone sets 32 and 35 connected to the switched telephone network 30, with another other party 34 with whom the user desires to make a remote payment, the other party can be sure of knowing the identity of the user of the pager unit 1 as follows:

- the user of the pager unit 1 gives the other party 34 an identification code which will generally be constituted by the user's personal radio pager number which number enables radio messages to be sent to the pager unit 1, after which the other party 34 enters the identification code into a computer system 36 (optionally the identification code may be sent directly to the computer system 36 after connection of the system to the switched telephone network 30, by causing the loudspeaker 9 to emit a run of individual sound signals corresponding to the various digits making up the identification code and implemented in the "voice frequency" dialing system specific to the telephone network);
- the computer system 36 connects itself via the switched telephone network 30 to the transmitter station 20 and causes a message to be sent to the pager unit 1, which message comprises a sequence of characters referred to as a "certification primary code";
- the CPU 7 is then programmed to cause the loudspeaker 9 to emit a warning sound signal, and to cause the screen 2 to display a message such as "enter your secret code";
- the user then enters the secret code into the pager unit 1 by means of the keypad 3, e.g. by successively selecting digits and/or letters from a set of digits and/or letters displayed on the screen 2, using the direction keys 3*a* and 3*b* and successively entering various digits or letters once selected by means of the enter key 3*c*, or else solely by using the direction keys 3*a* and 3*b*, with the secret code then being determined by a particular sequence of successive presses on the keys 3*b* and 3*c* (for example: two presses on the key 3*a*, four presses on the key 3*b*, one press on the key 3*a*, and one press on the key 3*b*);
- then, after the secret code has been entered, the CPU 7 is programmed to determine a "resultant" code which is a function of the certification primary code received by radio paging, of an internal code contained in the memory 8, and of the secret code entered by the user, and to cause said resultant code to be emitted by the loudspeaker 9 in the form of an encoded sound signal made up of a run of individual sound signals, this emission being triggered on command of the user, e.g. by pressing on the enter key 3*c* of the keypad, once the user has brought the loudspeaker 9 close to the microphone 32*b* of the telephone set 32;

the computer system 36 receives the resultant code over the switched telephone network 30 and it verifies whether a predetermined relationship exists between the identification code, the certification primary code, and the resultant code; and finally, the computer system 36 authorizes remote payment if the predetermined relationship is satisfied.

The way in which the resultant code is determined and the predetermined relationship that must exist between the identification code, the certification primary code, and the resultant code are not described in detail herein since numerous examples are well known to the person skilled in the art. For example, it would be possible to use a way of determining the resultant code and a type of predetermined relationship that must exist between the identification code, the certification primary code, and the resultant code of the kind commonly used in payment smart cards.

Also, it should be observed that in practice, the voice frequency dialing system used will generally be the dual tone multifrequency (DTMF) system in which each sound signal comprises two superposed frequencies.

Naturally, the above-described way of remotely identifying a person is not restricted to remote payment by bank card, and can be used in any application where it is necessary to identify a person.

When the pager unit 1 is fitted with a smart card reader 41, the identity of the user of the pager unit 1 can be verified as follows, in particular for the purpose of making a remote payment to the above-mentioned other party 34:

the user of the pager unit 1 inserts the smart card 40 into the reader 41;

the user of the pager unit 1 gives the other party 34 the number of the smart card, which may possibly be a bank card or some other payment card, and may possibly also give the other party 34 his or her own personal radio pager number if the number of the smart card 40 is insufficient for enabling the other party 34 to cause a radio message to be sent to the pager unit 1;

the other party 34 enters the number of the smart card 40, and where appropriate the personal radio pager number, into a computer system 36, with it being possible for the numbers in question optionally to be communicated directly to the computer system 36 by means of the sound signal emitter 9 of the pager unit 1, as already explained above;

the computer system 36 connects itself via the switched telephone network 30 to the transmitter station 20 and causes a message to be transmitted to the pager unit 1, which message includes a predetermined sequence of characters referred to as a "certification primary code";

the radio message is recognized by the pager unit 1 as being addressed thereto, with recognition of such addressing preferably taking place solely on the basis of the number of the smart card 40 with which the CPU 7 is in communication via the reader 41, in which case the user of the pager unit 1 need only give the number of the smart card at the beginning of the procedure, as explained above;

the CPU 7 is then programmed to cause an "initial" code to be sent to the smart card 40 via the reader 41, which initial code is a function of the certification primary code (and may be constituted by no more than the certification primary code or its own), and to cause the loudspeaker 9 to emit a warning sound signal and display a message on the screen 2 such as: "enter your secret code";

the user then enters the secret code into the pager unit 1 by means of the keypad 3 as already explained above;

then, after the secret code has been entered, the CPU 7 is programmed to send the secret code to the smart card 40 via the reader 41;

the smart card 40 determines a "resultant" code which is a function of the initial code, of an internal code contained in the smart card 40, and of the secret code entered by the user;

the resultant code is sent to the CPU 7 via the reader 41, and the CPU 7 defines an encoded sound signal representative of the resultant code;

the CPU 7 causes the encoded sound signal to be emitted by the loudspeaker 9 under user control, e.g. when the user presses the enter key 3*c* of the keypad with the loudspeaker 9 then being located in the vicinity of the microphone 32*b* of the telephone set 32;

the computer system 36 receives the encoded sound signal representative of the resultant code, reconstitutes the resultant code, and verifies whether a predetermined relationship exists between the number of the smart card, the certification primary code, and the resultant code; and finally, the computer system 36 authorizes remote payment if the predetermined relationship is satisfied.

The way in which the resultant code is determined and the way in which said predetermined relationship is verified are well known in the state of the art, as stated above.

We claim:

1. A portable one-way radio pager, comprising pager means (4, 5, 6) for receiving radio messages, a memory (8) for storing the messages, a screen (2), a keypad (3), a sound signal emitter (9), and an electronic CPU (7), the pager being designed to display on its screen at least some of the messages it receives, the sound signal emitter (9) being designed to emit sound signals in a plurality of frequencies, and the CPU (7) being designed:

to recognize, in received messages, at least a specific message fraction referred to as a "primary code" for causing an encoded sound signal to be emitted by the sound signal emitter (9);

to store in the memory (8) data representative of the received primary code; and as a function of commands received from a user by means of the keypad (3), to cause the sound signal emitter (9) to emit an encoded sound signal comprising a run of individual sound signals and defined by the CPU as a function at least of the primary code, said encoded sound signal varying as a function of the primary code;

the pager being characterized in that the CPU (7) is also designed:

to recognize at least one "certification" primary code and to display on the screen (2) a message requesting the user of said pager to enter a secondary code by means of the keypad (3);

then to define the encoded sound signal as a function of the primary code, of an additional code accessible to the CPU, and of the secondary code entered with the keypad (3); and finally, as a function of commands received from the user by means of the keypad (3), to cause the encoded sound signal to be emitted by the sound signal emitter (9).

2. A portable radio pager according to claim 1, in which the additional code is an internal code contained in the memory (8).

3. A portable radio pager according to claim 1, further including an interface (41) enabling it to dialog with an external smart card (40), and in which the CPU (7) is further designed:

to send an initial code that is a function of the primary code to the smart card (40) via the interface (41);

after the secondary code has been input with the keypad (3), to send the secondary code to the smart card (40) by means of the interface (41);

to receive the above-mentioned additional code, referred to as a "resultant" code, from the smart card (40) as defined by the smart card (40) as a function of the initial code sent thereto, of an internal code that it contains, and of the secondary code; and to define the encoded sound signal as a function of the resultant code received from the smart card (40).

4. A method of remotely identifying a person by using a portable radio pager (1) according to claim 1 which receives radio messages from at least one transmitter station (20), the method comprising the following steps:

a) making telephone contact with the user of the pager (1) by means of a telephone set (32);

b) causing the user of the pager (1) to communicate an identification code specific to the user;

c) causing the transmitter station (20) to transmit at least one certification primary code addressed to the pager (1);

d) causing the user of said pager to enter a secondary code by means of the keypad (3) of the pager;

e) causing the sound signal emitter (9) of the pager (1) to emit the encoded sound signal which is defined by the CPU (7) of the pager as a function of the primary code, of the internal code, and of the secondary code, the sound signal emitter (9) being located at that time in the vicinity of a microphone (32*b*) belonging to the telephone set (32);

f) determining the encoded sound signal which ought to have been emitted as a function of the primary code and of the secondary code;

g) verifying whether a predetermined relationship exists between the identification code, the certification primary code, and the encoded sound signal.

5. A method according to claim 4, in which the identification code specific to the user of the pager (1) is included in the memory (8) of the pager, and in which step b) consists in causing the sound signal emitter (9) of the pager (1) to emit a run of individual sound signals representative of the identification code, the signal emitter (9) being located at that time in the vicinity of a microphone (32*b*) belonging to the telephone set (32).

6. A method of remotely identifying a person using a portable radio pager (1) according to claim 3, which receives radio messages from at least one transmitter station (20), the method comprising the following steps:

a') making telephone contact with the user of the pager (1) by means of a telephone set (32);

b') causing the user of the pager (1) to communicate at least one identification code specific to the smart card (40) of the user;

c') causing the transmitter station (20) to transmit at least one certification primary code addressed to the pager (1);

d') causing the initial code which is a function of the certification primary code to be sent to the smart card (40) via the interface (41);

e') causing the user of said pager to enter a secondary code by means of the keypad (3) of the pager, and causing said secondary code to be sent to the smart card (40) via the interface (41);

f') causing the smart card (40) to communicate a resultant code to the CPU (7), which resultant code is a function of the initial code, of the secondary code, and of the internal code contained in said smart card;

g') causing the CPU (7) to define the encoded sound signal corresponding to the resultant code;

h') causing said encoded sound signal to be emitted by the sound signal emitter (9) of the pager (1), the sound signal emitter (9) being located at that time in the vicinity of a microphone (32*b*) belonging to the telephone set (32); and i') verifying whether a predetermined relationship exists between the identification code, the primary code, and the encoded sound signal.

7. A method according to claim 6, in which the identification code is stored in the smart card (40), and in which step b') consists in causing the CPU (7) to read the identification code of the smart card (40) via the interface (41), and in causing the sound signal emitter (9) to emit a run of individual sound signals representative of the identification code, the sound signal emitter (9) being located at that time in the vicinity of a microphone (32*b*) belonging to the telephone set (32).

8. A method according to any one of claims 4 to 7, including a subsequent step which consists in authorizing a remote payment operation only if it is verified that the predetermined relationship exists between the identification code, the certification primary code, and the encoded sound signal.

* * * * *